US005382734A

United States Patent [19]

Sardar et al.

[11] Patent Number: 5,382,734

[45] Date of Patent: Jan. 17, 1995

[54] THERMAL REFORMING OF NAPHTHENIC AND HYDRODEALKYLATION OF AROMATIC FEEDSTOCKS TO PRODUCE BENZENE

[75] Inventors: Hashim Sardar, Hamilton Square; Lawrence M. Abrams, Cherry Hill, both of N.J.

[73] Assignee: Hydrocarbon Research, Inc., Princeton, N.J.

[21] Appl. No.: 92,642

[22] Filed: Jul. 16, 1993

[51] Int. Cl.[6] ..... C07C 5/32; C07C 4/12; C10G 35/00

[52] U.S. Cl. ..... 585/431; 585/488; 208/133

[58] Field of Search ..... 585/431, 488; 208/133

[56] References Cited

U.S. PATENT DOCUMENTS

| | | | |
|---|---|---|---|
| 2,780,661 | 2/1957 | Hemminger et al. | 585/488 |
| 3,371,126 | 2/1968 | Carson | 585/488 |
| 3,404,191 | 10/1968 | Soderquist et al. | 585/431 |
| 3,517,076 | 6/1970 | Juhl et al. | 585/488 |

*Primary Examiner*—Anthony McFarlane
*Assistant Examiner*—Nhat D. Phan
*Attorney, Agent, or Firm*—Fred A. Wilson

[57] ABSTRACT

Hydrocarbon feedstocks containing tetra-hydro-dicyclo-penta-diene (THDCPD) dissolved in a suitable solvent is substantially totally reformed and hydroconverted in a non-catalytic reactor having length/internal diameter ratio between 10/1 and 30/1 at critical controlled reaction conditions, including molar ratio of hydrogen-to-THDCPD of 5.0:1–12.0:1, reaction temperature of 1100°–1350° F., reactor pressure of 550–650 psig, and feedstream reactor residence time of 10–50 seconds so as to yield primarily benzene product together with minor aromatic materials. Suitable solvent materials can be an aromatic solvent, a non-aromatic solvent containing naphthenic and paraffinic compounds, or a combination of each. When the solvent is predominantly an alkyl aromatics mixture, these components are hydrodealkylated while the THDCPD material undergoes simultaneous reformation in the reactor. Heavy mono-aromatic materials contained in the reactor effluent may be recycled back to the reactor to ultimately yield additional benzene, with minimal aromatics loss. Heavy fractions of biphenyl and alkylbiphenyls may also be recycled to the reactor to minimize formation of new biphenyl molecules.

11 Claims, 6 Drawing Sheets

THERMAL REFORMING OF NAPHTHENIC AND HYDRODEALKYLATION OF AROMATIC FEEDSTOCKS TO PRODUCE BENZENE

BACKGROUND OF INVENTION

This invention pertains to thermally reforming a heavy naphthenic compound tetra-hydro-dicyclo-penta-diene (THDCPD) dissolved in a suitable solvent material to produce benzene product. It pertains particularly to such a process for thermal reforming feedstocks containing the naphthenic compound THDCPD together with alkyl aromatic materials and simultaneously hydrodealkylating the aromatic materials to produce mainly benzene, along with only minor amounts of heavy multi-ring aromatic materials and gas by-products.

When hydrodealkylating heavy aromatic feedstocks including those containing appreciable amounts of THDCPD together with $C_9$ and $C_{10}$ mono-aromatic materials to yield mainly benzene product, it has been customary to minimize THDCPD compounds in the feedstock by a distillation step before the hydrodealkylation. At thermal hydrodealkylation reaction conditions, any naphthenes present in the feedstock would be expected to result in producing gas products such as methane and ethane and consume considerable hydrogen and also produce heavy multi-ring aromatics materials normally of little value. However, it has now been unexpectedly found that hydrocarbon feedstocks containing tetra-hydro-dicyclo-penta-diene (THDCPD) dissolved in alkyl aromatic fractions, can be simultaneously thermally reformed and hydrodealkylated successfully in a plug flow type non-catalytic reactor to produce significant yields of benzene product by utilizing a critical range of thermal reaction conditions. The reforming of the naphthenic THDCPD material and the simultaneous reforming and hydrodealkylation of THDCPD containing alkyl aromatic feedstocks to produce benzene were achieved during experimental work intended to process $C_9$+ heavy aromatic feedstock containing THDCPD in a hydrodealkylation (HDA) reactor unit to produce benzene product. This discovery advantageously permits processing heavy aromatic feedstocks containing the heavy naphthenic compound THDCPD, by utilizing existing hydrodealkylation process technology to produce additional benzene product without removing the naphthenic material from the feedstock. It is believed there is no prior art for reforming THDCPD to produce aromatics like benzene and toluene in a non-catalytic thermal reactor.

SUMMARY OF INVENTION

This invention provides a process for thermally reforming the $C_{10}$ naphthenic material tetra-hydro-dicyclo-penta-diene (THDCPD) dissolved in a suitable solvent to produce benzene product. Because the THDCPD material is a solid at ambient conditions, it needs to be processed by dissolving it in a suitable solvent up to the limits of its solubility. The solvent used can be either aromatic or non-aromatic in nature or mixtures thereof, but the economics of producing benzene makes an aromatic solvent preferable because the aromatics are readily converted along with THDCPD to produce mainly benzene product. Also if desired, the feedstock can be heavier fractions of pyrolysis gasoline or reformate containing THDCPD along with $C_9$–$C_{10}$ mono-aromatic material, as it is demonstrated in this invention that any mono-aromatic material that is present in the feedstock is hydrodealkylated simultaneously along with the reforming of THDCPD to produce benzene as the principal product. Thus, any aromatics which may be present in the THDCPD containing feedstock should not be removed. The feedstock may contain 5–80wt % THDCPD, and is reacted with hydrogen at critical reaction conditions in a plug flow type non-catalytic reactor similar to known hydrodealkylation (HDA) processes.

For this invention, it has been found that the critical reaction conditions are 1100°–1350° F. temperature, 45014 650 psig reactor pressure, hydrogen partial pressure of 240–600 psig, and 10–50 sec. feedstream residence time in the reactor, which conditions are similar to those for an hydrodealkylation process for aromatic feedstocks. The resulting aromatic effluent material from the reactor can then be further processed as desired by using suitable separation and distillation steps to yield principally benzene product. The hydrogen supplied to the reactor is controlled so that the molar ratio of hydrogen to the feedstock containing THDCPD at the reactor inlet is maintained within a critical range of 5.0:1–12.0:1, so as to minimize naphthenic and aromatic ring cracking and the formation of condensed heavy aromatics in the reactor. The reactor should provide essentially plug flow conditions and have a length/internal diameter ratio between 10/1 and 30/1, and preferably is 15/1–25/1. The reactor temperature is maintained in the critical range of 1100°–1350° F., and preferably is 1160°–1300° F, while the reactor pressure is maintained at 450–650 psig and preferably at 500–600 psig. The hydrogen to feed molar ratio at the reactor inlet is preferably maintained in the range of 6.0:1–8.0:1 and the feedstream residence time is preferably 15–30 sec.

In the reactor, the naphthenic material THDCPD along with an aromatic or non-aromatic solvent undergo essentially total hydroconversion under the plug flow reaction conditions, yielding predominantly lower carbon-content alkyl benzenes, with benzene being the major product. Specific reactor operating conditions and the product distribution at the reactor outlet are dependent upon the feedstock composition. At reaction conditions outside the critical range, ring cracking and heavy aromatics formation can undesirably reduce the ultimate benzene product yield, and may be disruptive to process operations by causing material precipitation and clogging of equipment. The reactor effluent material is subsequently distilled to separate the desired benzene product.

By properly adjusting the critical parameters of hydrogen-to-THDCPD or hydrogen-to-THDCPD plus aromatics mole ratio for the feedstock at the reactor inlet, the reactor temperature profile and the feedstock residence time or space velocity, the yield of aromatics and particularly benzene product is increased substantially and the aromatics loss due to condensed ring formation and ring cracking in the reactor is minimized. For a typical feedstock of THDCPD dissolved in $C_9$+ mono-aromatics mixture, the feedstock is completely reformed and hydrodealkylated to $C_8$ and lighter compounds in a single reaction pass. There is no need to recycle back to the reactor any feed material, so that only the recovered intermediate fractions need be recycled to the reactor for further reaction and hydroconversion therein, so as to increase the yield of benzene product.

The heavy aromatic materials formed in the reactor comprise naphthalene, biphenyl, and compounds heavier than biphenyl, and are typically 2–8 wt% of the feed depending on the fraction of THDCPD or the combined fraction of THDCPD and aromatics in the feed. When benzene is the only desired product, biphenyl contained in the reactor effluent is preferably recycled back to the reactor and allowed to equilibrate with benzene, thus minimizing formation of new biphenyl and minimizing benzene yield loss, with heavy aromatic materials being removed from the system. Reaction liquids other than benzene are also recycled back to the reactor for further reaction to ultimately produce more benzene product.

BRIEF DESCRIPTION OF DRAWINGS

This invention will be described further with reference to the following drawings, in which.

DESCRIPTION OF INVENTION

Figure 1:
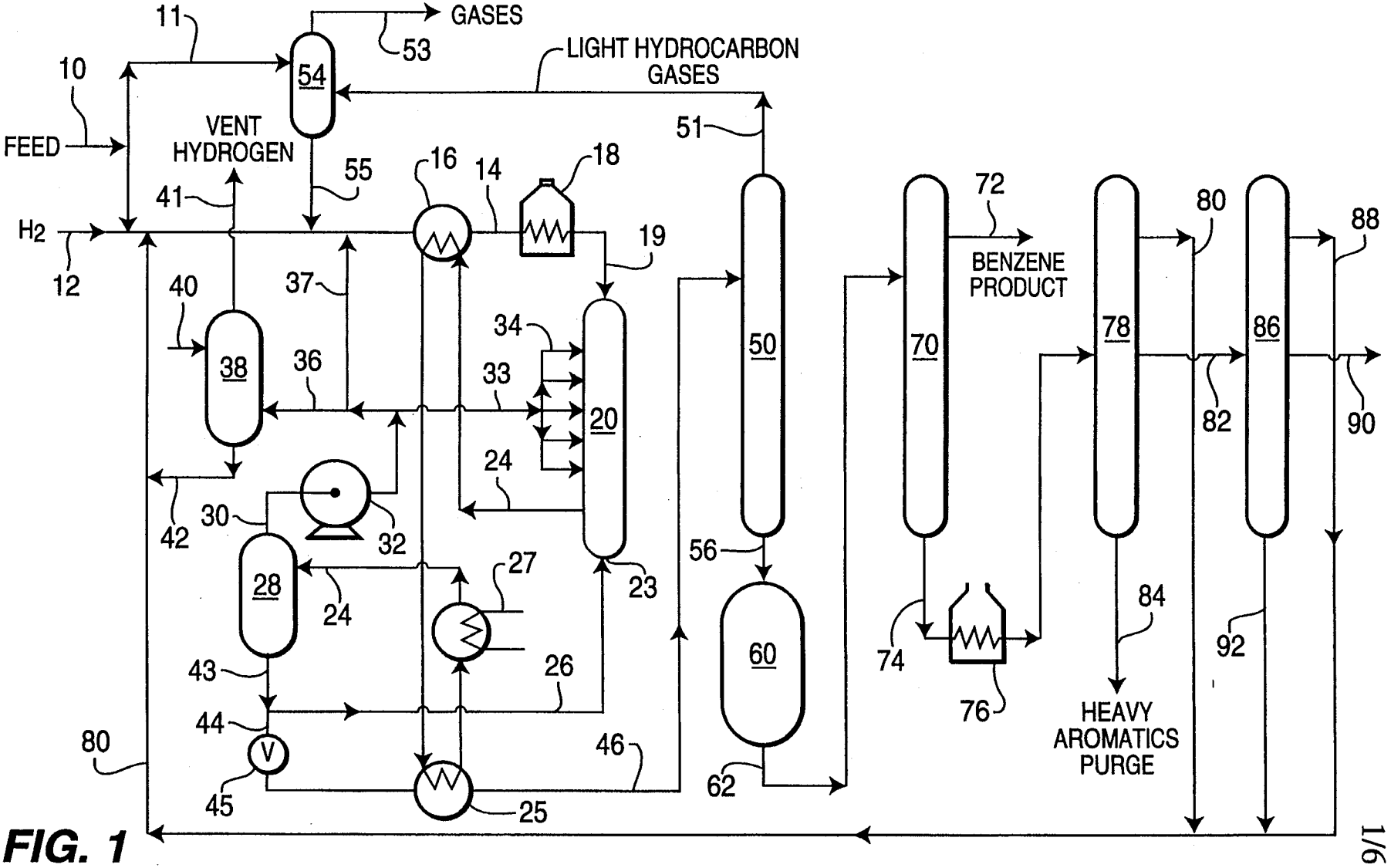
FIG. 1 shows a schematic flowsheet of a process for thermal reforming THDCPD dissolved in a suitable solvent to produce mainly benzene product according to the invention.

As shown by FIG. 1, a feedstream containing tetrahydro-dicyclo-penta-diene (THDCPD) dissolved in an aromatic or non-aromatic solvent is reacted with hydrogen in a plug flow type non-catalytic reactor to yield mainly benzene product along with some toluene and other minor materials. The THDCPD is thermally reformed to aromatics, while simultaneously hydrodealkylating any aromatics which are present in the feedstock to produce benzene. The pressurized feedstream at 10 is mixed with hydrogen at 12, and the combined feedstream 14 is preheated to near reactor temperature by heat exchange against reactor effluent at 16 and in fired heater 18. The heated feedstream is passed through conduit 19 and introduced into thermal reactor 20. The reaction conditions are maintained within a critical range as follows:

| | |
|---|---|
| Reaction Temperature, °F. | 1100–1350 |
| Reactor Pressure, psig. | 450–650 |
| Molar Ratio of $H_2$/THDCPD plus Aromatics at Reactor Inlet | 5.0–12.0 |
| Feed Residence Time in Reactor, sec. | 10–50 |

The reactor 20 is an elongated internally insulated chamber having length/internal diameter ratio between 10/1 and 30/1, and containing no catalyst and having no effective catalytic surfaces. The reactor is preferably operated at temperatures between 1160 and 1300° F. and at reactor pressures between 500 and 600 psig and at a hydrogen to feed mole ratio of 6.0–8.0. The reactor 20 is sized and feedstock flowrate is selected so that the residence time for the total feed material is preferably in the range of about 15–40 seconds.

The temperature profile in the reactor 20 is controlled by injection of multiple gas quench streams 34, so that the reaction temperature does not exceed 1350° F. at any point within the reactor. The temperature increase across the reactor length should not exceed about 200° F. and preferably does not exceed 150° F. The reaction temperature is controlled so that essentially all of the THDCPD in the feed undergoes reforming and hydrodealkylation reactions to produce predominantly benzene product together with some toluene and minor materials. At the reactor outlet, the reactor effluent stream 24 is quenched to about 1200° F. by a liquid quench stream 26 and then cooled as is further described herein below.

The reactor effluent stream 24 is preferably cooled by heat exchange against the reactor feedstreams 14 in heat exchanger 16, and is also cooled in heat exchanger 25 against stabilizer tower feed stream 46. Effluent stream 24 is further cooled in exchanger 27 such as with air or water, before entering phase separator 28. From separator 28, a resulting vapor stream 30 is suitably compressed at 32, and portion 33 of the compressed vapor stream is used to quench the hydrodealkylation reactions in reactor 20 through the multiple gas quench streams 34 to control the temperature profile in the reactor, so as preferably to provide a substantially straight line temperature increase throughout the reactor length.

Also from the separator 28, another portion 36 of compressed vapor stream 33 passes to vent gas hydrogen absorber 38, and flows counter-current therein to a suitable scrubbing liquid provided at 40. The resulting scrubbed hydrogen gas leaves as vent stream 41. The remaining portion 37 of the vapor at 30 and liquid at 42 from absorber 38 are combined with the feedstream 14 and are recycled back to the reactor 20, so as to maintain the desired hydrogen-to-feed ratio at the reactor inlet.

Also from the separator 28, a portion of the liquid fraction withdrawn at 43 provides the quench stream 26 to the outlet of reactor 20. The net liquid at 44 from separator 28 is pressure-reduced at 45 and passes through heat exchanger 25 and conduit 46 to stabilizer distillation tower 50. Light hydrocarbon gases and any water present in the stream 46 to stabilizer tower 50 are removed overhead at 51. A portion 11 of the feedstream 10 may be used as lean oil to an absorber 54 to recover benzene from the stabilizer tower overhead vent stream 51. From the absorber 54, overhead gas stream 53 is removed, and rich oil stream 55 containing benzene leaving the absorber 54 is mixed with the reactor feedstream 14.

From the stabilizer tower 50, the bottoms fraction 56 is withdrawn and passed to clay absorber tower 60, to remove traces of unsaturated compounds and color bodies. The effluent stream 62 passes to benzene recovery distillation tower 70 which is operated at near atmospheric pressure. A high purity benzene product having a yield at least 60 mole % of the THDCPD plus aromatic feed components is removed overhead at 72, and a heavier aromatics-containing bottoms material is withdrawn at 74.

From the benzene recovery tower 70, the aromatics-containing bottoms stream 74 is passed through a heater 76 to recycle tower 78, from which an alkylated aromatic mixture containing $C_7$ and $C_8$ aromatic products formed in the reactor 20 is removed overhead at 80, and may be recycled back to the feedstream 14. A net heavy aromatics bottoms material is withdrawn as a purge at 84. The scrubbing liquid stream 40 for the vent $H_2$ absorber 38 may either be an external toluene feed stream, or toluene recycled from the recycle tower overhead stream 80.

From recycle tower 78, a liquid sidestream 82 containing naphthalene and biphenyl is passed to second recycle tower 86 for further recovery of any mono-aromatics in overhead stream 88, as a recycle liquid. A sidestream 90 containing mainly naphthalene is withdrawn, and a bottoms stream containing mainly biphenyl is withdrawn at 92 and may be recycled back to the feedstream 14 so as to increase the overall yield of the benzene product.

As heretofore mentioned, the criticality of the reaction conditions for this invention depends on the hydrogen-to-THDCPD plus aromatics mole ratio and reactor residence time for the feedstock, a reactor temperature profile being maintained within the desired 1100°–1300° F. temperature range and not exceeding 1350° F., operating pressure level of 450–650 psig, and the length/internal diameter ratio of 10/1–30/1 in the reactor 20. By maintaining these critical control parameters, feedstream vaporization and reaction is assured and better material distribution is provided in the reactor, reactor hot spots are avoided, formation of heavier aromatic material is minimized, and the benzene product yields are enhanced to at least 60 mol percent of the feedstock depending on the THDCPD and aromatics content in the feed. The feedstream at 19 from the heater furnace 18 need not be heated above about 1200° F., and thus comparatively little reaction will occur in the furnace 18 and transfer conduit 19. In this way, the hydroconversion reactions will occur primarily in the reactor 20 and the desired critical temperature profile can be maintained throughout the reaction chamber with the aid of thermocouples that are used to indicate and control temperature therein by the multiple gas quench streams 34. It will be recognized that the reactor quench lines 34, shown diagrammatically in the FIG. 1, represent the introduction of controlled amounts of quench gas at various levels along the reactor length, under control of suitable thermocouples therein.

This invention will be further described by the following examples, which should not be construed as limiting the scope of the invention.

EXAMPLE 1

Figure 2A:
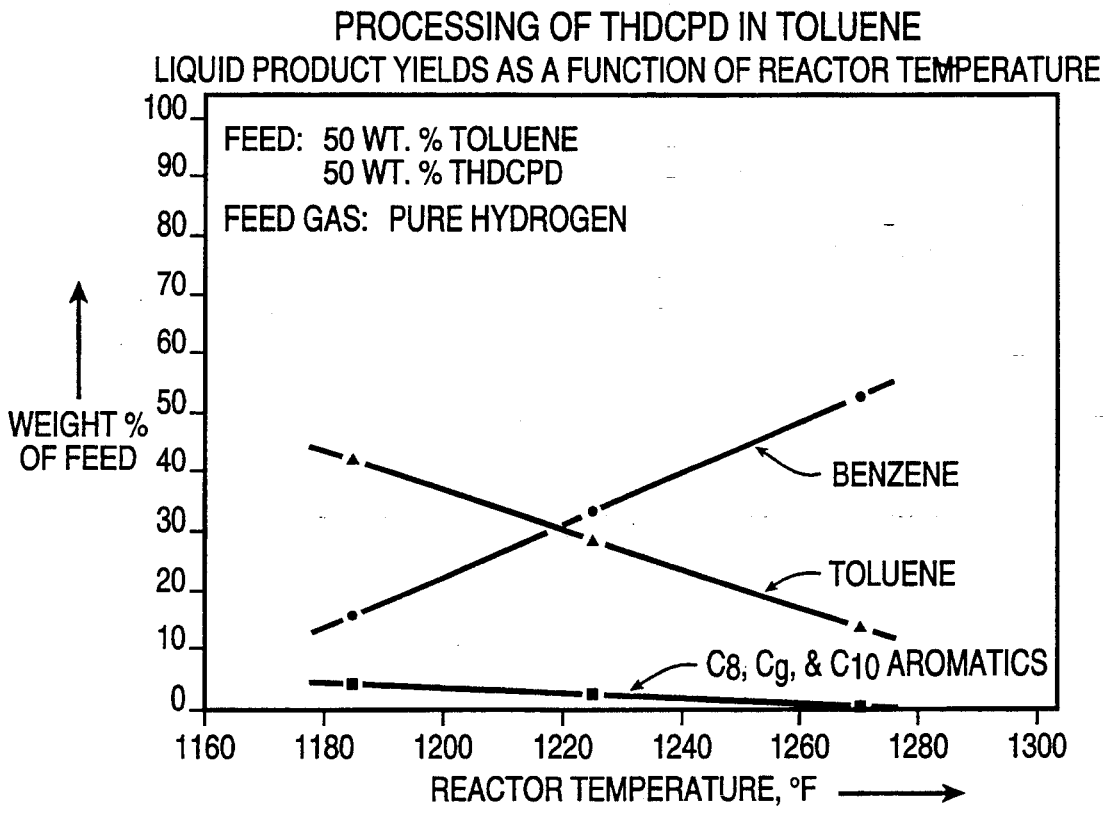
FIGS. 2A, 2B, 2C, 3A, 3B, 3C, 4A, 4B and 4C are graphs showing yield results for benzene and other products formed at various reaction conditions from feedstocks containing THDCPD dissolved in predominantly aromatic solvent mixtures.
Figure 2B:
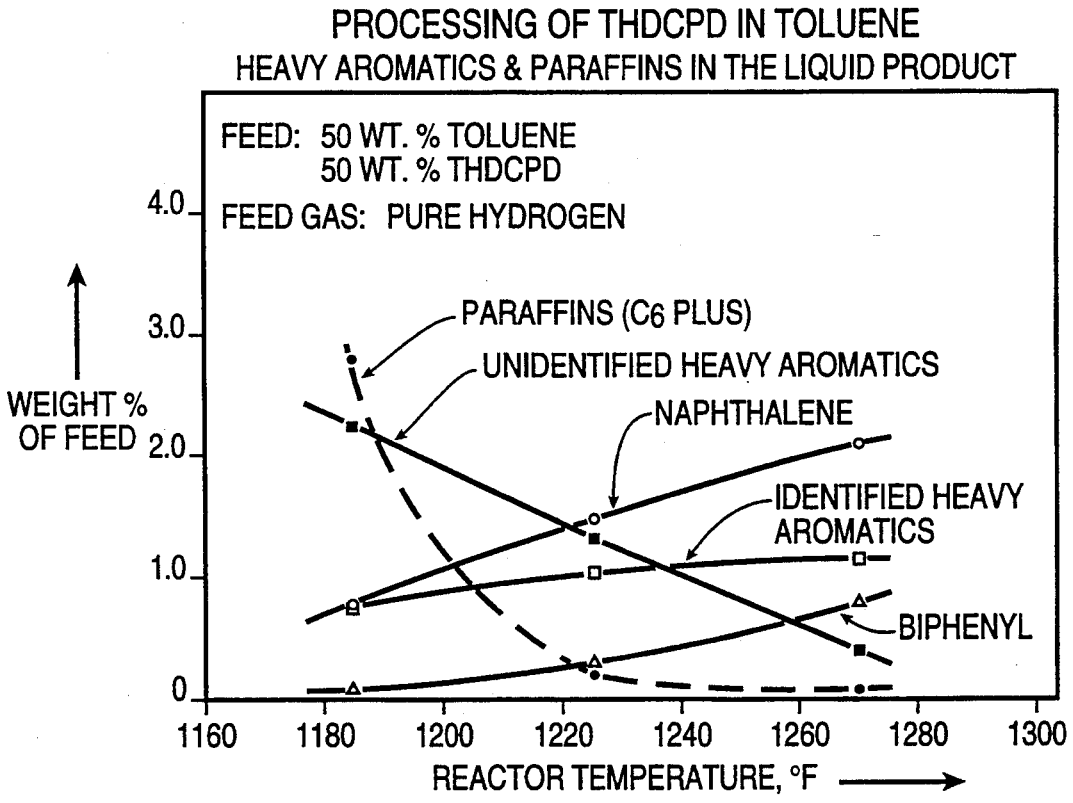
Figure 2C:
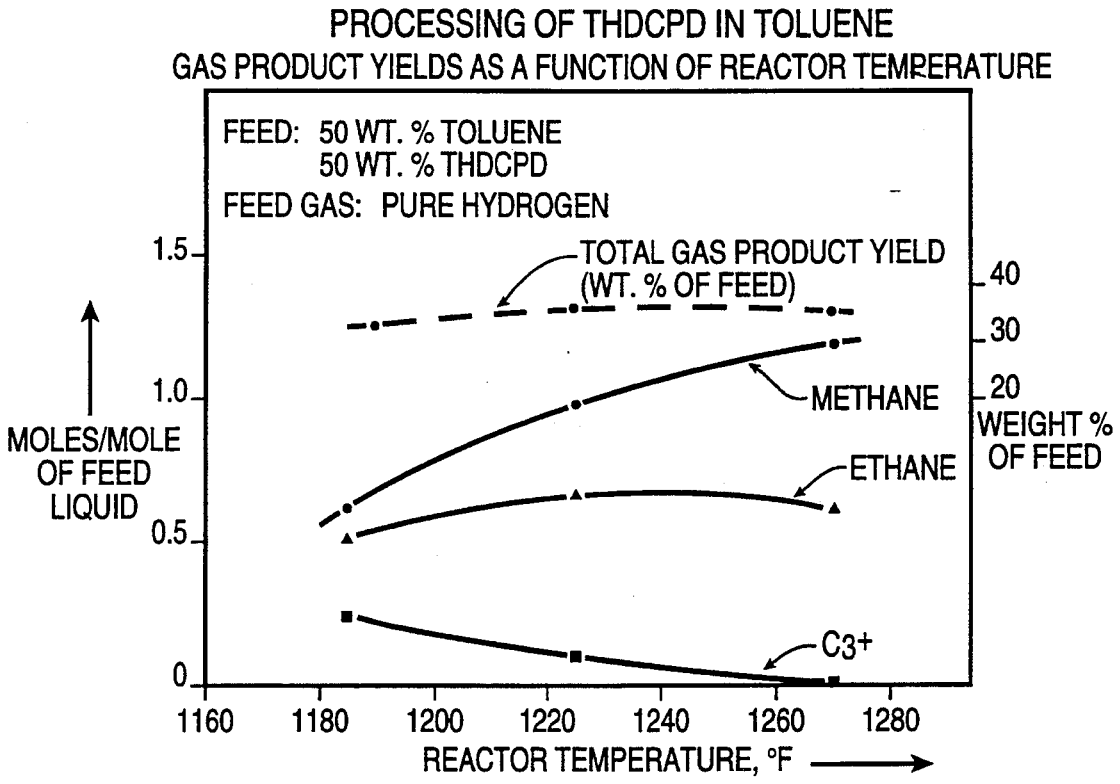
Figure 3A:
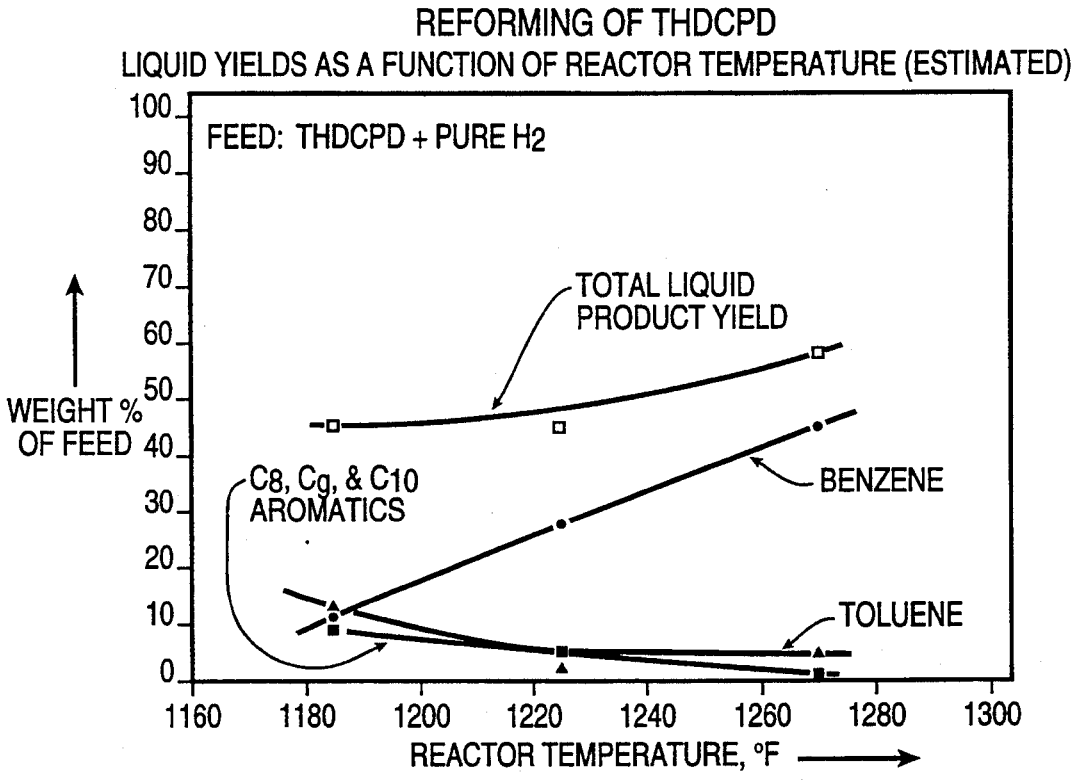
Figure 3B:
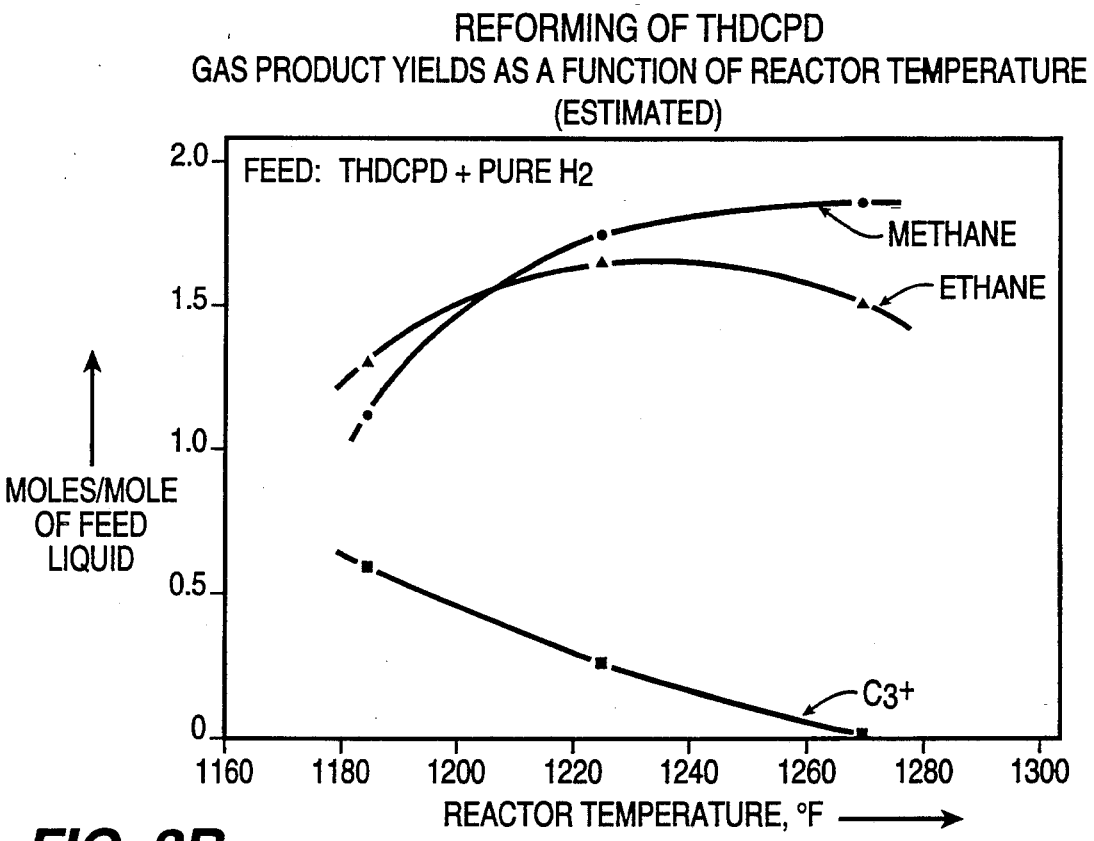
Figure 3C:
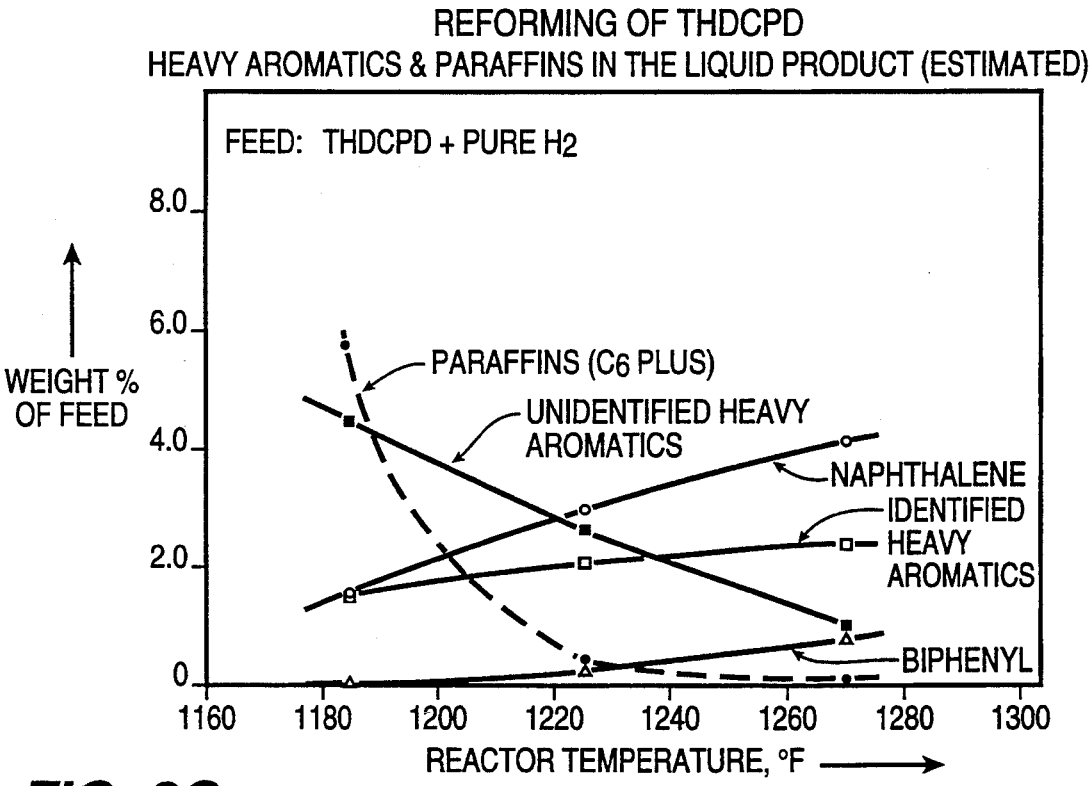

Numerous experimental runs were made on feedstreams containing THDCPD in a small bench-scale isothermal reactor unit having length/internal diameter ratio exceeding 10/1. The first runs were made using a feedstream containing 50 wt % tetra-hydra-dicyclo-penta-diene (THDCPD) mixed with 50 wt % toluene and high purity hydrogen to determine the percentage conversion of THDCPD compound to benzene product. Because the $C_{10}$ THDCPD material is a wax-like solid at room temperature, these experiments could not be carried out with the pure 'THDCPD' feed material alone, but were conducted by dissolving the 'THDCPD' in toluene to form the 50/50 wt % feed mixture. Reaction conditions used were 1180°–1280° F. temperature, 600 psig reactor pressure, 25 second residence time, and hydrogen to THDCPD plus aromatic molar ratio of 6.5–7.0/1 at the reactor inlet. The experimental results using the THDCPD/toluene mixture are presented in FIGS. 2A–2C. These reaction results were then corrected for results obtained for similar reactions on toluene feed alone so as to obtain reaction results for conversion of the 'THDCPD' feed material alone to benzene and other products. The results for reaction of THDCPD alone with high purity hydrogen and 1180°–1280° F. temperature are shown by FIGS. 3A–3C.

These results showed that for the 'THDCPD' alone as a feed material, significant product yields of mono-aromatic materials occurred. As shown by FIG. 3A, at the low 1180° F. temperature, the yields of benzene, toluene and $C_8$ aromatics were all about the same, and totalled about 32 wt % of THDCPD feed. However, at higher reactor temperature of 1270° F., the benzene yield was about 42 wt. %, and the toluene plus aromatic yield was only about 5 wt %. Thus, at the lower reactor temperatures the aromatics yield was only about 65% of the yields obtained at the higher temperature. The loss of 'THDCPD' to yield light gases like methane, ethane and $C_3$+ paraffins varies with the reactor temperature, as shown by FIG. 3B. In addition to light gases production, heavy aromatic components like naphthalene, biphenyl and anthracene are also formed in the reactor and account for a maximum of about 8 wt % at high reactor temperatures, as shown by FIG. 3C. For the entire temperature range studied, the THDCPD conversion was essentially complete.

It is noted that these results indicate that the $C_{10}$ naphthenic material THDCPD can be successfully reformed and hydrodealkylated to produce principally benzene product at reaction conditions suitable for hydrodealkylating feedstocks containing all aromatic compounds.

EXAMPLE 2

Figure 4A:
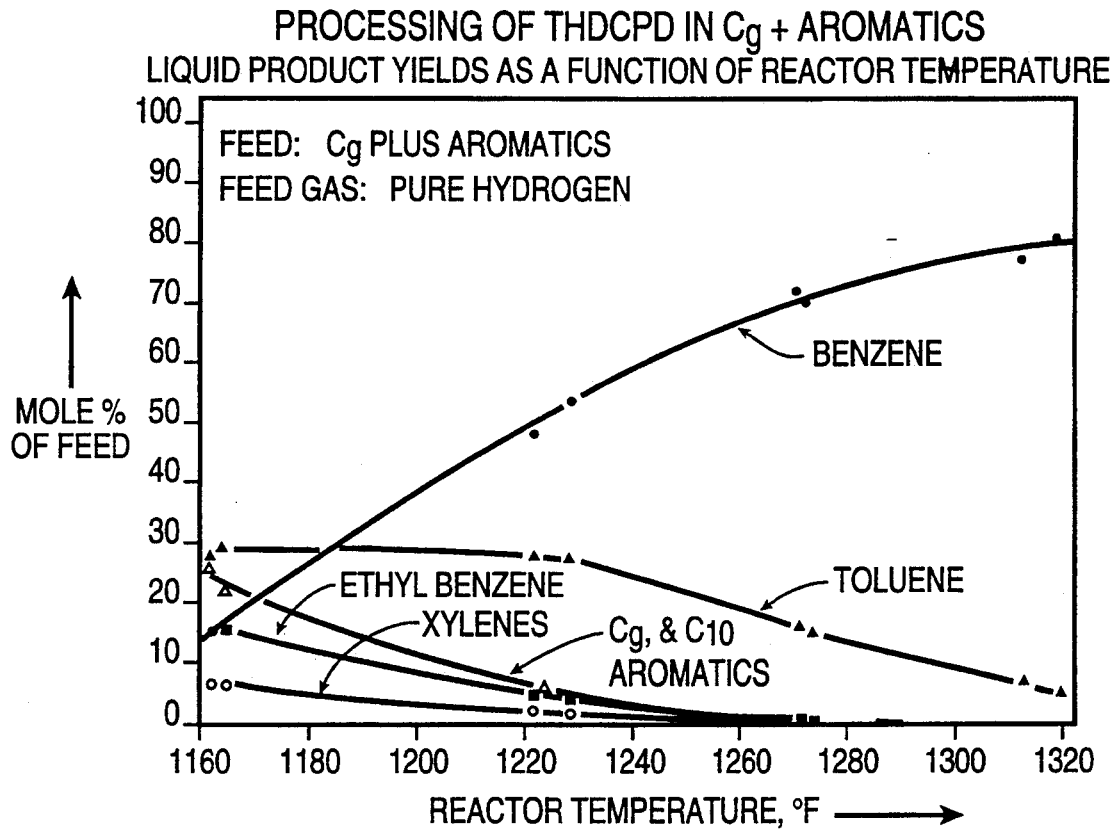
Figure 4B:
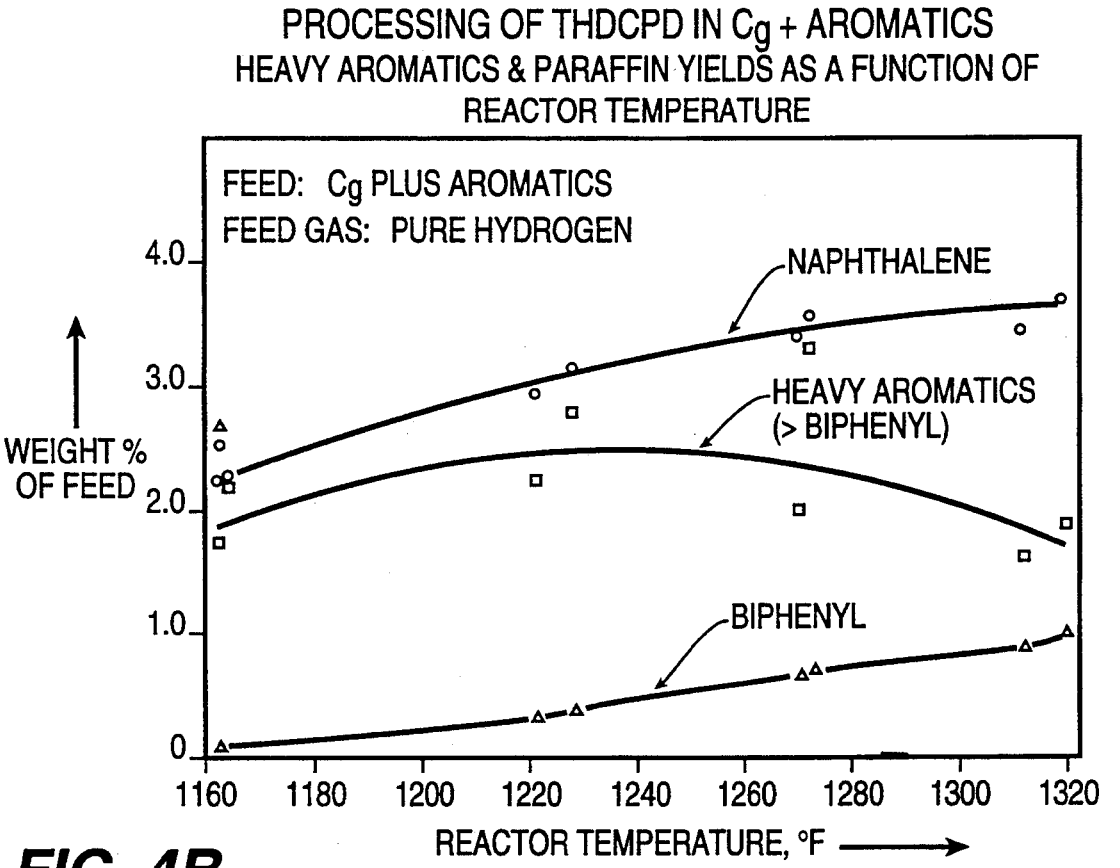
Figure 4C:
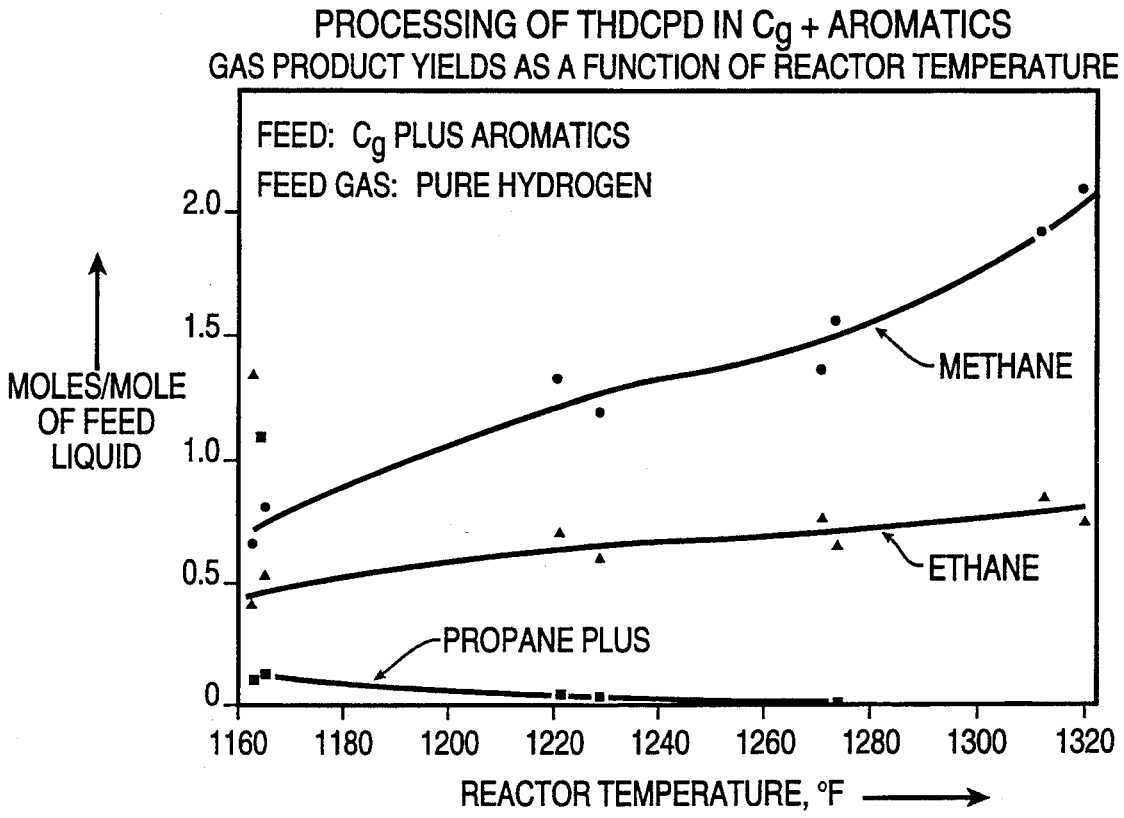

Other experimental runs were made using the same small bench-scale isothermal reactor unit on a pyrolysis gasoline derived THDCPD feedstock containing about 80 wt. % $C_9$+ aromatics. These runs were made at 1160°–1320° F. temperature and approximately 600 psig pressure using pure hydrogen and at hydrogen/feed mole ratio of 8.5/1 and 25 seconds residence time in the reactor. The results also confirmed the complete conversion of THDCPD while at the same time hydrodealkylating the aromatic materials which were present in the feed. The experimental results obtained are shown in FIGS. 4A–4C.

These results showed that benzene yield increased from about 15 mole % at 1160° F. reactor temperature up to about 80 mole % of the feed at 1320° F. temperature, while the yield of toluene, $C_9$–$C_{10}$ aromatics and other materials decreased significantly. Also, the yield of naphthalene, biphenyl, and gases increased only marginally with the increase in reactor temperature. The overall benzene plus mono-aromatics yield obtained was as much as 15 mole % more than what could be obtained by reacting only the aromatics portion of the feedstock.

Although we have described our invention broadly and also in a preferred embodiment, it is understood that modifications and variations can be made thereto all within the scope as defined by the following claims.

We claim:

1. A process for thermal reforming heavy naphthenic tetra-hydro-dicyclo-penta-diene (THDCPD) to produce mainly benzene product along with minor amounts of various aromatic materials and gaseous by-products, the process comprising:

(a) providing a feedstream containing tetra-hydro-dicyclo-penta-diene (THDCPD) dissolved in a suitable solvent material up to the limit of its solubility, and mixing the feedstream with sufficient hydrogen to provide a molar ratio of hydrogen/THDCPD of 5.0:1–12.0:1;

(b) reacting the feedstream and hydrogen in a reactor having length/internal diameter ratio of at least 10/1 and at reaction conditions of 1100°–1350° F. temperature, 450–650 psig reactor pressure, and 10–50 seconds residence time to produce an aromatic effluent material; and (c) cooling the reactor effluent material and phase separating it to recover hydrogen for recycle to the reactor, to maintain the hydrogen/THDCPD molar ratio therein; and distilling a remaining liquid material to recover mainly benzene product together with other aromatic materials.

2. The process of claim 1, wherein the feedstream contains 5–80 wt % tetra-hydro-dicyclo-penta-diene (THDCPD) which is dissolved in $C_7$–$C_{10}$ alkyl aromatic, materials up to the limit of solubility of the THDCPD.

3. The process of claim 1, wherein the feedstream contains 5–80 wt % tetra-hydro-dicyclo-penta-diene (THDCPD) which is dissolved in a non-aromatic solvent containing naphthenic and paraffinic materials up to the limit of solubility of the THDCPD.

4. The process of claim 1, wherein the feedstream contains 5–80 wt % tetra-hydro-dicyclo-penta-diene (THDCPD) dissolved in a mixture of aromatic and non-aromatic solvents containing $C_7$–$C_{10}$ alkyl aromatics, naphthenic and paraffinic materials.

5. A process for simultaneous thermal reforming of tetra-hydro-dicyclo-penta-diene (THDCPD) and hydrodealkylation of a solvent containing primarily monoaromatic compounds to produce light aromatic products along with minor amounts of heavy aromatic bottoms fractions, the process comprising:

(a) providing a feedstream containing naphthenic tetra-hydro-dicyclo-penta-diene (THDCPD) and $C_7$–$C_{10}$ alkyl aromatic solvent compounds in which the THDCPD compound is 5–80 wt % of the feedstream, together with sufficient hydrogen to provide a molar ratio of hydrogen-to-THDCPD plus aromatics within a range of 5.0:1–12.0:1;

(b) feeding said naphthenic and aromatic feedstream with hydrogen to a thermal reactor having a length/internal diameter ratio of at least about 10/1 so as to provide substantially plug flow conditions in the reactor;

(c) maintaining the reactor temperature at between 1100° and 1350° F., reactor pressure between 450 and 650 psig, and a combined feedstream residence time of 10–50 seconds, and simultaneously reforming the naphthenic and hydrodealkylating the aromatic compounds and to produce an aromatic effluent material; and (d) cooling the reactor effluent material and phase separating it to recover hydrogen, recycling a portion of the recovered hydrogen back to the reactor together with fresh make-up hydrogen to maintain the hydrogen-to-THDCPD plus aromatics ratio therein, and distilling the remaining liquid fractions to recover mainly benzene product together with other minor aromatic materials.

6. The process of claim 5, including the additional steps of recovering from the reactor effluent a portion of biphenyl together with intermediate $C_7$ and $C_8$ aromatics and unconverted alkyl aromatic solvent compounds, and recycling said compounds back to the reactor so as to yield at least 60 mole % benzene product, and withdrawing a heavy aromatic bottoms material.

7. The process of claim 5, wherein a naphthalene and biphenyl-containing stream from a first distillation recovery tower is passed to a second recovery tower from which a biphenyl-containing bottoms stream is recycled back to the feedstream.

8. The process of claim 5, wherein the molar ratio of hydrogen/THDCPD is 6.0:1–8.0:1, and feedstream residence time is 15–40 seconds.

9. The process of claim 5, wherein the reaction temperature is maintained at 1160°–1300° F., and the temperature profile increase does not exceed 150° F. from the inlet to exit end of the reactor.

10. The process of claim 5, wherein the thermal reactor has length/internal diameter ratio of 15/1–25/1.

11. A process for simultaneous thermal reforming of tetra-hydro-dicyclo-penta-diene (THDCPD) and hydrodealkylation of an aromatic solvent containing $C_7$–$C_{10}$ alkyl aromatic compounds to produce mainly benzene product along with minor amounts of heavy aromatic bottoms fractions, the process comprising:

(a) providing a feedstream containing a mixture of 5–80 wt. % naphthenic tetra-hydro-dicyclo-penta-diene (THDCPD) and $C_7$ and $C_{10}$ alkyl aromatic compounds, together with sufficient hydrogen to provide a molar ratio of hydrogen-to-THDCPD plus aromatics of 6.0:1–8.0:1, and preheating the combined feedstream to a temperature between 1100° and 1200° F. so as to avoid premature reactions;

(b) feeding said preheated naphthenic and aromatic feedstream together with hydrogen to a thermal hydrodealkylation reactor having a length/internal diameter ratio of 15/1–25/1, so as to provide substantially plug flow conditions in the reactor;

(c) maintaining the reactor temperature at between about 1160° and 1300° F., by controlling temperature increase in the reactor by injecting a quench medium at multiple locations along the reactor length, maintaining reactor pressure between about 500 and 600 psig, and a combined feedstream residence time of 15–40 seconds, and simultaneously reforming the naphthenic and hydrodealkylating the aromatic compounds to produce an aromatic effluent stream; and (d) cooling the reactor effluent stream and phase separating it to recover hydrogen, recycling a portion of the recovered hydrogen back to the feedstream to maintain the hydrogen to THDCPD plus aromatics ratio in the reactor, and successively distilling the remaining liquid fractions to yield at least 60 mole % benzene product together with other minor aromatic materials.

* * * * *